US007985137B1

(12) United States Patent
Klitsner et al.

(10) Patent No.: US 7,985,137 B1
(45) Date of Patent: Jul. 26, 2011

(54) HAND-HELD ELECTRONIC GAME DEVICE

(75) Inventors: Daniel B. Klitsner, Larkspur, CA (US); Daniel C. Sanfilippo, East Longmeadow, MA (US)

(73) Assignees: Klitsner Industrial Design, Inc, San Francisco, CA (US); Hasbro, Inc., Pawtucket, RI (US)

( * ) Notice: Subject to any disclaimer, the term of this patent is extended or adjusted under 35 U.S.C. 154(b) by 1157 days.

(21) Appl. No.: 11/181,092

(22) Filed: Jul. 13, 2005

(51) Int. Cl.
*A63F 9/24* (2006.01)

(52) U.S. Cl. ..... 463/38; 463/7; 463/31; 463/35

(58) Field of Classification Search ..... 273/237, 273/445; 463/7–10, 31, 35, 38
See application file for complete search history.

(56) References Cited

U.S. PATENT DOCUMENTS

| | | | | | |
|---|---|---|---|---|---|
| 3,933,354 | A | * | 1/1976 | Goldfarb et al. | 273/445 |
| 4,169,592 | A | * | 10/1979 | Hall | 463/7 |
| 4,240,638 | A | | 12/1980 | Morrison et al. | 273/237 |
| 4,363,482 | A | | 12/1982 | Goldfarb | 463/9 |
| 4,572,513 | A | | 2/1986 | Evans | 273/242 |
| 4,770,416 | A | | 9/1988 | Shimizu et al. | 273/1 GC |
| 4,895,364 | A | * | 1/1990 | Martel et al. | 273/237 |
| 4,957,291 | A | | 9/1990 | Miffitt et al. | 273/153 R |
| 4,969,647 | A | | 11/1990 | Mical et al. | 273/85 G |
| 5,009,419 | A | | 4/1991 | Streeter | 273/454 |
| 5,011,156 | A | | 4/1991 | LaChance, Jr. et al. | 273/237 |
| D320,624 | S | | 10/1991 | Taylor | D21/13 |
| 5,120,065 | A | | 6/1992 | Driscoll et al. | 273/237 |
| 5,277,429 | A | | 1/1994 | Smith, III | 273/237 |
| 5,411,271 | A | | 5/1995 | Mirando | 273/434 |
| D363,320 | S | | 10/1995 | Barthelemy et al. | D21/48 |
| 5,465,982 | A | | 11/1995 | Rebane | 273/433 |
| 5,478,240 | A | | 12/1995 | Cogliano | 434/327 |
| 5,630,754 | A | | 5/1997 | Rebane | 463/9 |
| 5,685,776 | A | | 11/1997 | Stambolic et al. | 463/46 |
| 5,816,580 | A | | 10/1998 | Osborne et al. | 273/454 |
| 5,839,976 | A | | 11/1998 | Darr | 473/414 |
| 5,844,377 | A | | 12/1998 | Anderson et al. | 315/251 |
| 5,855,513 | A | | 1/1999 | Lam | 463/9 |
| 5,893,798 | A | | 4/1999 | Stambolic et al. | 463/46 |

(Continued)

OTHER PUBLICATIONS

"Bopit Extreme 2," © 2002 Hasbro Corp., pp. 1-4.*

(Continued)

*Primary Examiner* — Peter DungBa Vo
*Assistant Examiner* — Steve Rowland
(74) *Attorney, Agent, or Firm* — Miller, Matthias & Hull, LLP

(57) ABSTRACT

The invention is directed to a hand-held game apparatus and method providing an elimination game wherein audible and/or visual signals instruct players to manipulate particular input devices, such as a push button, a pull knob or a twist knob, to actuate a corresponding switch. If the particular input device is not manipulated within a predetermined period of time, such as one second, the game may output an audible and/or visual error signal, stopping play and indicating that the player who failed to manipulate the input device is eliminated from that round of play. The audible signals instructing a player to manipulate an input device can be selected to be voice messages, musical sounds, or other prompts corresponding to each input device. Similarly, the visual signals may correspond to each input device, and may comprise the illumination of lights disposed at each of the input devices. The game apparatus may further include moveable components allowing the players to rearrange the game apparatus into different physical configurations.

18 Claims, 2 Drawing Sheets

U.S. PATENT DOCUMENTS

| | | | | |
|---|---|---|---|---|
| 5,906,369 | A | 5/1999 | Brennan et al. | 273/238 |
| 5,935,193 | A * | 8/1999 | Saiki | 701/211 |
| 6,050,895 | A * | 4/2000 | Luciano et al. | 463/7 |
| 6,086,478 | A | 7/2000 | Klitsner et al. | 463/35 |
| 6,150,774 | A | 11/2000 | Mueller et al. | 315/291 |
| 6,210,278 | B1 | 4/2001 | Klitsner | 463/35 |
| 6,540,615 | B2 | 4/2003 | Tanaka et al. | 463/44 |
| 6,848,992 | B2 | 2/2005 | Adams | 463/9 |
| 2001/0009866 | A1 | 7/2001 | Klitsner et al. | 463/35 |
| 2002/0111202 | A1 | 8/2002 | Annis et al. | 463/7 |
| 2004/0263696 | A1 * | 12/2004 | Rogers | 348/734 |
| 2005/0170873 | A1 * | 8/2005 | Fishbach et al. | 463/9 |
| 2005/0187024 | A1 | 8/2005 | Cho et al. | 463/46 |

OTHER PUBLICATIONS

"Air Snares~ electronic Drum game," eBay® Item No. 3144223049, Sep. 2, 2003, downloaded at http://cgi.ebay.com/ws/eBayISAPI.dll?ViewItem&item=3144223049&category=38287, 2 pages.

"Electronic Air Snares game drum sticks New," eBay® Item No. 3143836654, Sep. 2, 2003, downloaded at http://cgi.ebay.com/ws/eBayISAPI.dll?ViewItem&itern=3143836654&category=232, 2 pages.

"Air Snares Drum Game by Mattel," amazon.com, Sep. 2, 2003, downloaded at http://www.amazon.com/exec/obidos/tg/detail/-/B00005LO9D/102-6848557-8380121?v=glance&s=toys&v..., 1 page.

"Air Snares Drum Game by Mattel," amazon.com, Sep. 2, 2003, downloaded at http://www.amazon.com/exec/obidos/tg/stores/detail/-/toys/B00005LO9D/reviews/102-2501523-9173739/1..., 1 page.

"Air Snares Drumming Game," Web News and Product Reviews, Sep. 2, 2003, downloaded at http://www.webdesk.com/air-snares/, 2 pages.

U.S. Appl. No. 10/941,590, entitled "Electronic Sequence Matching Game and Method of Game Play Using Same," filed Sep. 15, 2004 (47 pages).

U.S. Appl. No. 10/947,736, entitled "Game Having an Electronic Instruction Unit," filed Sep. 23, 2004 (42 pages).

U.S. Appl. No. 11/194,508, entitled "Electronic Tag Game and Instruction Unit," filed Aug. 1, 2005 (35 pages).

U.S. Appl. No. 11/421,647, entitled "Game Having an Electronic Instruction Unit with a Mechanical Die Agitator" filed Jun. 1, 2006 (37 pages).

U.S. Appl. No. 11/426,420, entitled "Game Having an Electronic Instruction Unit," filed Jun. 26, 2006 (39 pages).

U.S. Appl. No. 29/235,077 filed Jul. 27, 2005, and listing Daniel C. Sanfilippo as inventor (27087/40561) (18 pages).

Nu Jam Guitar™ Product Operating Instructions bearing a 2002 copyright registration indication (6 pages).

Groove It™ Product Operating Instructions bearing a 2003 copyright registration indication (6 pages).

* cited by examiner

HAND-HELD ELECTRONIC GAME DEVICE

BACKGROUND OF THE INVENTION

The present invention relates to hand-held electronic games and, more particularly, to a game apparatus and a method for a hand-held voice and visual game of elimination played by a single player or by multiple players manipulating input devices of the game in response to audible and/or visual instructions provided by output devices of the game apparatus.

Apparatus are known for playing games that generate voice instructions or sound prompts at a game apparatus. Players listen to the voice instructions or sound prompts produced by the game apparatus and perform predetermined operations in accordance with the voice instructions or sound prompts. For example, U.S. Pat. No. 4,770,416 to Shimizu et al. discloses a vocal game device in which players record voice commands corresponding to selected operations that are to be performed by the players. The Shimizu et al. device includes four input switches that are each a different color and contain a lamp for lighting. Players respond to the voice commands generated by the device and the lighting of the lamps during the course of play.

Another device, disclosed by U.S. Pat. No. 5,271,627 to Russell et al. provides audible sounds indicating particular targets that are active for a player to strike. The targets are spatially located around a player and when a target becomes active, a sound prompt is generated and the target is lighted so that the player can quickly identify and strike the active target.

Apparatus are also known wherein players perform different actions in response to sound prompts during the course of play. For example, U.S. Pat. Nos. 6,086,478 and 6,210,278 to Klistner et al. and Klistner, respectively, disclose hand-held games that include a plurality of input devices, an audible output device, and a controller coupled to each of the input devices and to the audible output device. Preferably, each of the input devices requires a different mechanical action for activation, such as a pressure switch, a pull switch or a rotational switch. The controller outputs a first command signal to the audible output device that relates to a first selected input device. The controller then outputs a second command signal to the audible output device relating to a second selected input device when the first selected input device is actuated within a predetermined period of time. When the first selected input device is not actuated within the predetermined period of time, or when an input device other than the selected input device is actuated in response to the first command signal, the controller outputs an error command signal to the audible output device. The controller then ceases to output command signals to the audible output device after outputting the error command signal. According to the invention, the second command can relate to a second selected input device or can be an audible indication, such as a voice message, for a user to pass the game apparatus to another user.

U.S. Patent Appl. Pub. No. 2002/0111202 to Annis et al. discloses a hand-held electronic game with audio directions having a center with two connected elongated ends for bending and rotating relative to the center by a player. Position sensing switches provide input to a control module. Various pre-programmed games may be played according to directions from the control module. In one, players are given "hot"/"cold" directions as they attempt to transform the game into a predetermined, but undisclosed, configuration. For another, there are directions, such as "bend it," which have a number of correct responses. There is a "bend it back" direction which requires recall of the prior "bend" move for the one correct response. Another variation gives a sound that must precede a direction to authorize the player to follow the direction. Each particular configuration may also be identified by a sound effect requiring the player to recall the shape associated with the sound.

SUMMARY OF THE INVENTION

In one aspect the invention is directed to a game apparatus for one or more users that may include a plurality of input devices each requiring a mechanical action for actuation, wherein at least two of the mechanical actions may be different, and wherein at least two input devices may require the same mechanical action for actuation, an output device, and a controller operatively connected to each of the input devices and to the output device. The controller may be programmed to cause the output device to output a command signal specific to the input devices requiring the same mechanical action, and to determine whether any of the input devices are actuated within a predetermined time period. The controller may further be programmed to cause the output device to output a race-winner signal corresponding to the first of the input devices requiring the same mechanical action actuated within the predetermined time period in response to determining that at least one of the two input devices requiring the same mechanical action was the first input device actuated within the predetermined time period.

In another aspect, the invention is directed to a game apparatus for one or more users that may include a plurality of input devices each requiring a mechanical action for actuation, wherein at least two of the mechanical actions are different, an audible output device, a visual output device and a controller operatively connected to each of the input devices, to the audible output device, and to the visual output device. The controller may be programmed to cause the audible output device to output an audible command signal specific to one of the input devices, to cause the visual output device to output a visual command signal specific to one of the input devices, and to determine whether any of the input devices are actuated within a predetermined time period. The controller may also be programmed to cause the audible output device to output an error signal in response to detecting the actuation of any of the input devices within the predetermined time period if the input device corresponding to the visual command signal is not the same as the input device corresponding to the audible command signal.

In a further aspect, the invention is directed to a game apparatus for one or more users that may include a center element, a first outwardly-extending arm connected to the center element, and a second outwardly-extending arm moveably connected to the center element, wherein the second arm may be moveable relative to the center element between a first position and a second position. The game apparatus may further include a plurality of input devices each requiring a mechanical action for actuation, wherein at least two of the mechanical actions may be different, and wherein each input device may be disposed on one of the center element, the first arm and the second arm, an audible output device, and a controller operatively coupled to each of the input devices and to the audible output device. The controller may be programmed to select one of the input devices, to cause the audible output device to output an audible command signal specific to the selected input device, and to determine whether the selected input device is actuated within a predetermined time period. The controller may also be programmed to cause the audible output device to output an error signal in response to detecting the actuation of an input device other than the selected input device, and to cause the audible output device to output an error signal in response to determining that the selected input device is not actuated within the predetermined time period.

In a still further aspect, the invention is directed to a method of playing an electronic elimination game having a game apparatus that may include at least three input devices each requiring a mechanical action for actuation, wherein at least two of the mechanical actions may be different. The method may include outputting from the game apparatus a first audible instruction to perform one of the mechanical actions, outputting from the game apparatus a first visual instruction to perform one of the mechanical actions, and determining at the game apparatus whether one of the input devices is actuated within a predetermined time period. The method may further include outputting from the game apparatus an error message in response to determining that at least one of the input devices was actuated within the predetermined time period if the mechanical action corresponding to the first visual instruction is different than the mechanical action corresponding to the first audible instruction.

In yet another aspect, the invention is directed to a method of playing an electronic elimination game having a game apparatus including at least three input devices each requiring a mechanical action for actuation, wherein at least two of the mechanical actions may be different, and wherein at least two of the input devices may require the same mechanical action for actuation. The method may include outputting from the game apparatus a first instruction to perform one of the mechanical actions, and determining at the game apparatus whether one of the input devices is actuated within a predetermined time period. The method may further include outputting from the game apparatus an error message in response to determining that an input device actuated within the predetermined time period is not an input device actuated by the mechanical action of the first instruction, outputting from the game apparatus an error message in response to determining that no input device was actuated within the predetermined time period, and outputting from the game apparatus a race-winning message corresponding to the first input device actuated within the predetermined time period in response to determining that an input device actuated by the mechanical action of the first instruction was actuated within the predetermined time period if the mechanical action of the first instruction is the mechanical action required to actuate the at least two of the input devices.

Additional aspects of the invention are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . ." or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1A:
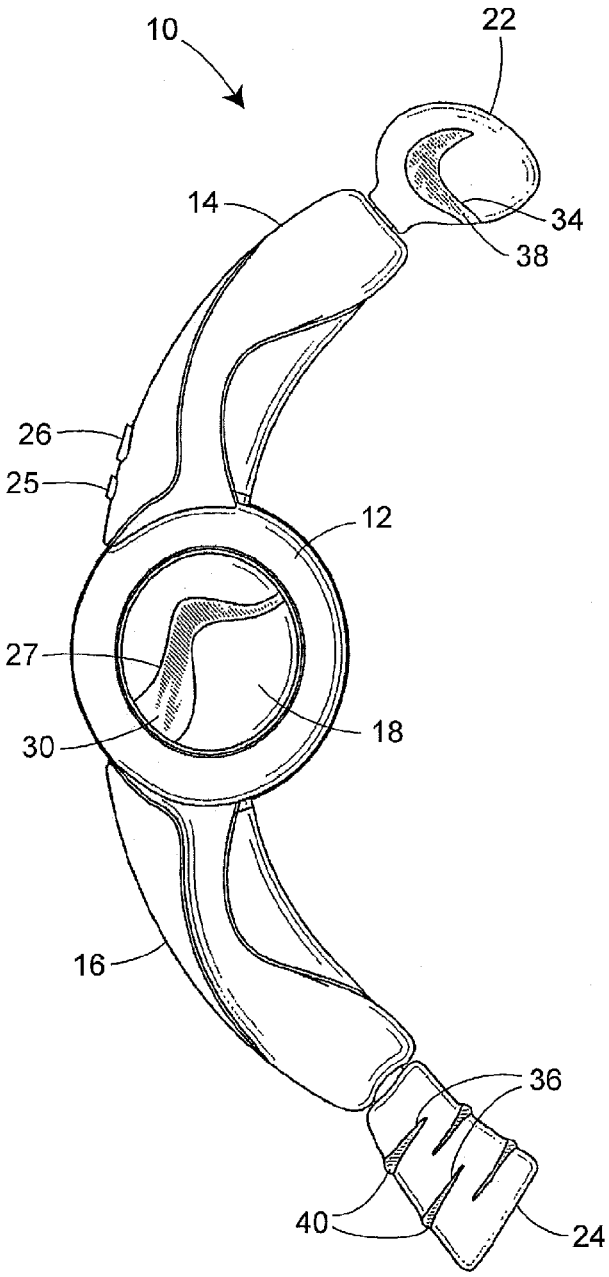
FIG. 1A is a front view of an embodiment of a hand-held electronic game in accordance with the present invention in a first configuration.
Figure 1B:
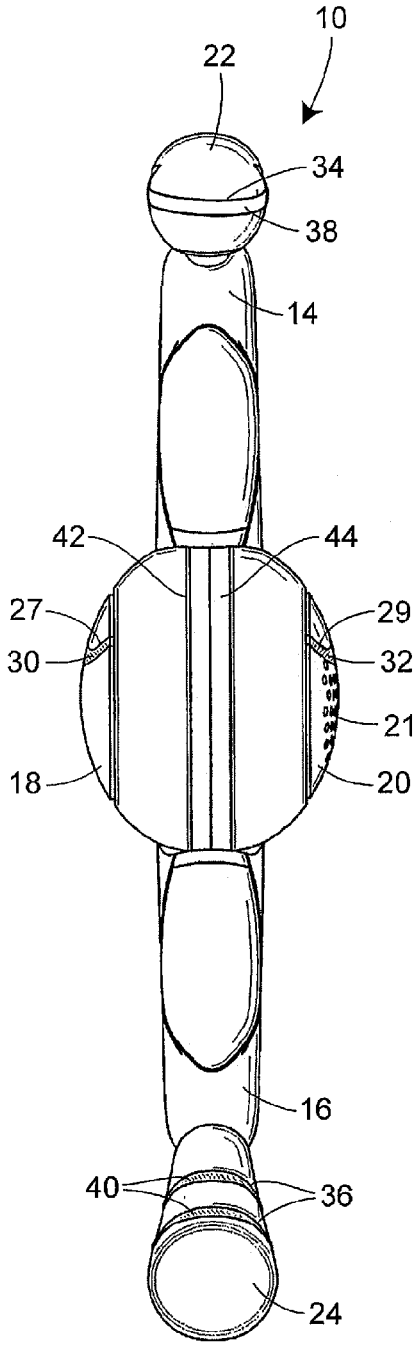
FIG. 1B is a side view of the hand-held electronic game of FIG. 1A.

FIGS. 1A and 1B show front and side views, respectively, of an embodiment of a hand-held game 10 of elimination in accordance with the present invention. The game 10 may provide audible and visual signals instructing a player to manipulate a particular input device, such as a push button, a pull knob or a twist knob, to actuate a corresponding switch. If the particular input device is not manipulated within a predetermined period of time, such as one second, the game may output an audible and/or visual error signal, stopping play and indicating that the player who failed to manipulate the input device is eliminated from that round of play. The audible signals instructing a player to manipulate an input device can be selected to be voice messages, musical sounds, or other prompts corresponding to each input device. Similarly, the visual signals may correspond to each input device. The game 10 may further include moveable components allowing the players to rearrange the game 10 into different physical configurations.

As shown in FIGS. 1A and 1B, the game 10 may include a spherical center element 12, and a first outwardly extending arm 14 and a second outwardly extending arm 16 attached to the center element 12. The arms 14, 16 may be configured to provide convenient gripping of the arms 14, 16 by the players. The center element 12 and the arms 14, 16 may be fabricated with hollow compartments therein for housing the electronic components of the game 10 described more fully below.

The game 10 may further include different types of input devices that may be accessible at different locations on the game 10, and may require different mechanical actions to actuate corresponding switches. In the illustrated embodiment, the game 10 may include push buttons 18, 20 disposed on either side of the center element 12 that may be operatively connected to corresponding switches disposed within the center element 12 so that a player may actuate one of the switches by pressing the corresponding one of the push buttons 18, 20. The push button 20 may also provide an area of openings 21 so that sound produced by an audible output device, such as a speaker, can be heard during the course of play.

A pull knob 22 may be located at the end of the first arm 14 opposite the center element 12 and may be operatively connected to a switch disposed within the first arm 14. The pull knob 22 may be slidable within an opening at the end of the first arm 14 and biased toward an inward normal position by a spring or by the switch to which the pull knob 22 is operatively connected. The switch may be actuated by pulling the pull knob 22 partially or fully outwardly from the first arm 14. A twist knob 24 may be located at the end of second arm 16 opposite the center element 12 and may be operatively connected to a further switch disposed within the second arm 16. The twist knob 24 may be rotatable within an opening at the end of the second arm 16 and biased toward a normal position by a spring or by the switch to which the twist knob 24 is operatively connected. The switch may be actuated by rotating twist knob 24 about a rotational axis. The game 10 may further include a game selection button 25 and a mode selection button 26 on the arm 14 that may be pressed by players to actuation corresponding game and mode selection switches to allow players to select the desired game as discussed further below.

The game 10 may further include visual output devices corresponding to each of the input devices 18-24 discussed above. In one embodiment, each of the input devices 18-24 may have a light disposed within the input device, and the input devices 18-24 may be configured so that the lights are perceptible by the players when the lights are illuminated. For example, in the illustrated embodiment, the push buttons 18, 20 may each have an opening 27, 29, respectively, allowing light to be visible from the exterior of the push buttons 18, 20 when the corresponding lights are illuminated. To protect the internal components from the environment, inserts 30, 32 fabricated from a transparent or partially transparent material may be disposed in the openings 27, 29, respectively. If desired, the inserts 30, 32 or the lights within the push buttons 18, 20 may be colored for aesthetic purposes or for use in enhancing the game play offered by the game 10. Similarly, the pull knob 22 and twist knob 24 may include similar openings 34, 36, respectively, and inserts 38, 40, respectively, such that the knobs 22, 24 may be illuminated by lights disposed therein. As an alternative, the buttons 18-24 may be fabricated from a translucent or partially translucent material, and be coated with an opaque covering, such as paint coating, while leaving portions of the translucent material exposed and defining the openings 27, 29, 34, 36.

Figure 2:
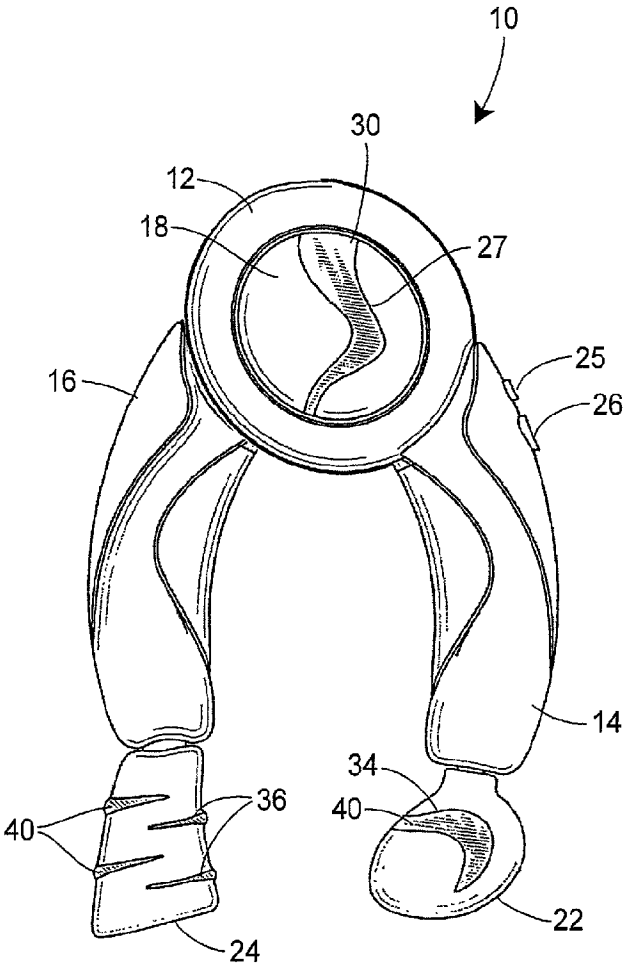
FIG. 2 is a front view of the hand-held electronic game of FIG. 1A in a second configuration.

As previously mentioned, the components of the game 10 may be moveable to facilitate arranging the game 10 in different physical configurations by the players. Referring to FIG. 1B, the center element 12 may have a slot 42 through the outer surface, and the arm 16 may include an attachment portion 44 extending therefrom and being disposed within slot 42. The attachment portion 44 of the arm 16 may be connected and rotatable within the center element 12 to pivotally mount the arm 16 to the center element 12. The attachment portion 44 may be slidable within the slot 42 so that a player may rotate the arm 16 in a circular path between the position of FIG. 1A giving the game 10 a relatively straight configuration and the position of FIG. 2 giving the game 10 a horseshoe-shaped configuration. In one embodiment, the center element 12 may include a spring-biased detent engaging corresponding surfaces of the attachment portion 44 so the at the arm 16 may be moved to and retained in the positions shown in FIGS. 1A and 2 and one or more intermediate positions if desired. Alternatively, the attachment portion 44 may be frictionally engaged by the center element 12 to retain the arm 16 in a given position until moved to a different position by a player.

While the illustrated embodiment shows the arm 16 being pivotally connected to the center element 12, those skilled in the art will understand that the arm 16 and, if desired, the arm 14 may be connected such that the arm or arms may move along non-circular paths between first and second positions. Still further, those skilled in the art will understand that the center element 12 and moving arm 16, and the electrical elements disposed therein, may be configured such that the electrical elements remain operatively connected as the arm 16 moves relative to the center element 12 between the first and second positions.

Figure 3:
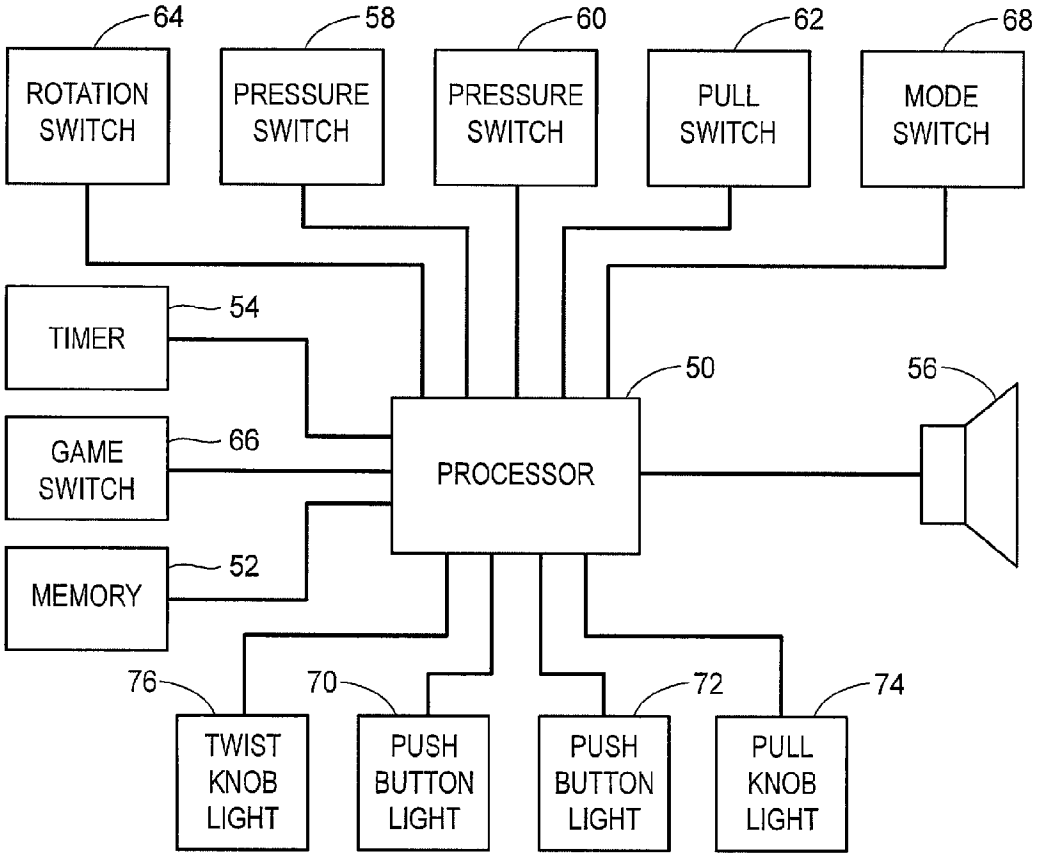
FIG. 3 is a block diagram of the electronic components of the hand-held electronic game of FIG. 1A.

FIG. 3 shows a schematic block diagram of the internal electrical components of the game 10 in accordance with the present invention. A processor or controller 50 may be operatively connected to a memory 52, a timer 54, an audio output device 56, push button switches 58, 60, a pull knob switch 62, a twist knob switch 64, a game selection switch 66, a mode selection switch 68 and lights 70-76. The memory 52 may store instructions that are executable by processor 50 for providing a plurality of different game play formats, such as those described below. The memory 52 may also store data relating to voice instructions and relating to musical sounds or prompts that are generated during the course of play, and may further include logic for illuminating the lights 70-76 during game play. The timer 54 may be used for measuring a predetermined period of time, such as one second, in which a specified input device must be manipulated for game play to progress, and for generating a game tempo that may increase randomly as game play progresses. The processor 50, memory 52 and timer 54 may be readily available integrated circuits that have operational capabilities that are suitable for providing the functions of the present invention. Additionally, the functions of the present invention can be performed by an application specific integrated circuit (ASIC), by dedicated logic circuits or by a state machine.

It should also be appreciated that the processor 50, memory 52 and timer 54 may be implemented on the printed circuit boards, and more complex implementations of the game 10 may be implemented wherein the electrical components of the game 10 may comprise, among other components, a program memory, a microcontroller or microprocessor (MP), a random-access memory (RAM), read-only memory (ROM), and an input/output (I/O) circuit, all of which may be interconnected. It should be appreciated that the processor 50 may include multiple microprocessors. Similarly, the memory 52 may include multiple RAMs and multiple program memories, depending on the complexity and requirements of a specific implementation. It should also be appreciated that the I/O circuit may include a number of different types of I/O circuits, such as sound generation circuits, video generation circuit, odor generation circuitry, and the like. The RAM(s), ROM(s) and program memories may be implemented as semi-conductor memories, magnetically readable memories, and/or optically readable memories, for example.

The audible output device 56, such as a speaker, receives command signals generated by processor 50 during the course of play and generates audible voice instructions or musical prompts. The memory 52 may store command signals corresponding to both male and female voices. Alternatively, if processor 50 does not have the capability to drive the speaker 56 directly, an output conditioning device can be used for conditioning the command signals in a well-known manner for driving the speaker 56. The lights 70-76 may be operatively connected to the processor 50 such that the processor 50 may illuminate the lights 70-76 when necessary during the course of game play. The lights 70-76 may be any illumination source capable of producing the visual commands and/or graphics necessary for the game play of the game 10, such as light bulbs, light emitting diodes (LEDs), multicolor LEDs, LED displays, and the like.

FIG. 3 illustrates that the processor 50 may be operatively coupled to various electronic components corresponding to the exterior components of the center element 12 and arms 14, 16 discussed in relation to FIGS. 1A and 1B, with each of those components being so coupled to the processor 50 via a respective direct line or conductor. Different connection schemes may be used. Input signals produced by the switches 58-68 are output to the processor 50 for processing the game execution logic, and the switches 58-64 and the lights 70-76 may correspond to the push buttons 18, 20, pull knob 22 and twist knob 24, respectively. Consequently, the push buttons 18, may be operatively connected to the switches 58, 60, respectively, and have the push button lights 70, 72, respectively, disposed therein, the pull knob 22 may be operatively connected to the switch 62 and have the pull knob light 74 disposed therein, and the twist knob 24 may be operatively connected to the switch 64 and have the twist knob light 76 disposed therein.

After a predetermined period of inactivity of the game 10, such as five minutes, the processor 50 may enter a sleep mode to conserve power. The processor 50 may be configured to detect the actuation of one of the switches 58-68 when the processor 50 is in the sleep mode, and to switch to an active game mode in response. The processor 50 may turn on the game 10, with the processor 50 drawing power from a power source, such as batteries stored within a battery compartment of the center element 12 or one of the arms 14, 16. When the processor 50 initiates the active mode of the game 10, the players may be able to select a desired one of the available games by pressing the game button 25, and a desired mode for the selected game by actuating the switch 68 by pressing the mode button 26.

In alternate embodiments, the game 10 may omit the buttons 25, 26 and switches 66, 68, and be configured to allow selection of games and modes using the input devices 18-24 and switches 58-64. For example, in one embodiment players may press one of the push buttons 18, 20 to actuate the corresponding switch 58, 60, respectively, to cycle through the available games, turn the twist knob 24 to actuate the switch 64 and cycle through the available game modes and, once the desired game and mode are selected, pull the pull knob 22 to actuate the switch 62 and begin the selected game. The available game modes may include game play with voice commands, game play with musical commands, game play controlled by illumination of the lights 70-76, and game play controlled by a combination of audio and visual commands. The voice commands may be provided in a male voice, a female voice or a combination of male and female voices, with the voice mode being selected via a voice selection input device, such as by pulling the pull knob 22 after selecting the voice command mode. Once the game and mode are selected, a player may start the game by pressing one of the push buttons 18, 20. Of course, those skilled in the art may configure the processor 50 as desired to allow selection of the available games, modes and voices, and start the game based on the manipulation of particular ones of the input devices 18-24.

In general, the game play associated with the game 10 includes the processor 50 causing commands to be output to the players via the speaker 56 and/or the lights 70-76 specifying one or more of the push buttons 18, 20, pull knob 22 and twist knob 24 to be manipulated by a player, the processor 50 receiving actuation signals generated by the switches 58-68 when a player manipulates the corresponding push buttons 18, 20, pull knob 22 and twist knob 24, and the processor 50 determining whether the actuation signal or signals correspond to the specified input device or devices the player was instructed to manipulate by the output commands. If a player manipulates the correct input device or devices in response to an instruction within the predetermined period of time, the processor 50 may select another or an additional input device to be manipulated at random and generate corresponding command signals for output to the speaker 56 and/or the lights 70-76. If a player manipulates an incorrect input device, or does not manipulate the correct input device within the predetermined period of time, as measured by the timer 54, the processor 50 may generate an error command signal for output to the speaker 56, such as a scream and/or a drum tag, or other appropriate error sound, and/or an appropriate visual error indication, such as flashing the lights 70-76.

The game 10 may be programmed with a plurality of game play formats. In a first game play format, the present invention may be adapted for use by a solo game player or for one player at a time in turn. In this format, the present invention may provide voice instructions that must be followed by the game player. After actuating the designated switches 58-64 to select the solo game play format, a player may press one of the push buttons 18, 20 to start play. The processor 50 may be programmed to cause the speaker to generate one measure of an underlying beat, followed by a voice instruction to manipulate one of the input devices 18-24. For example, the speaker 56 may broadcast the instruction "Bop It" to indicate that one of the push buttons 18, 20 must be pressed, may broadcast the instruction "Pull It" to indicate that the pull knob 22 must be pulled, and may broadcast the instruction "Twist It" to indicate that the twist knob 24 must be turned. As discussed above, depending on the mode selected by the player, the instructions may be in the form of musical instructions or visual instructions. In an embodiment of musical instructions, a bass drum sound may correspond to the "Bop It" instruction, a low-pitched ratchet sound may correspond to the "Twist It" instruction, and an upwards whistle sound may correspond to the "Pull It" instruction. In the visual instruction mode, the processor 50 may illuminate one of the lights 70-76 to specify to the player which of the input device 18-24 to manipulate.

The player must follow the voice instruction generated by the game 10 in tempo with the underlying beat by manipulating the specified input device 18-24 within a relatively short period of time. If the player successfully manipulates the specified input device 18-24 and, consequently, actuates the corresponding switch 58-64, the processor 50 may continue to select input devices 18-24 to be manipulated and cause the speaker 56 to broadcast the corresponding instruction that must be executed by the player. The solo game play may continue in this manner until the player makes a mistake either by failing to manipulate the specified input device 18-24 within the set period of time or by manipulating the wrong input device 18-24. Also during the game, the processor 50 may randomly increase the tempo of the underlying beat as the game progresses. When the player commits an error during play, an error signal or sound may be produced followed by an audible indication of the player's score, such as a count of drum beats or a verbal indication of the number of correct manipulations of the specified input devices 18-24 by the player.

A second game player format may be similar to the solo game play format but may be configured for two or more players. As with the solo game play format, the game 10 may output audible or visual messages instructing a player to manipulate the input devices 18-24, along with an audible underlying beat, with the player following the instructions generated by the game 10 in tempo with the underlying beat by performing an appropriate operation within a relatively short period of time, such as one second. In this game play format, the end of a player's turn may be indicated by a voice instruction to "pass it" output by the game 10 instructing the player to pass the game 10 to the next player, such as to the player to the left, as the game 10 outputs a measure of "pass it" music. The game play may continue in this manner with the players passing the game 10 until a player makes a mistake either by failing to perform the specified instructions within the set period of time or by performing the instruction incorrectly. When a player makes a mistake, the game 10 may generate a scream sound, indicating that the current player has been eliminated, and play stops. The remaining players may continue playing the game in the same manner until one player remains, who is the winner. As with the solo game play format, the processor 50 may increase the tempo of the game randomly as the game progresses.

In another alternate game play format for two players, the players may be required to keep up with the sequence of instructions output by the game 10, and attempt to be the first player to score a predetermined number of points by responding to commands correctly and racing to press a designated one of the push buttons 18, 20. In this embodiment, the input devices 18-24 may be color-coded, such as by using colored lights 70-76 or by having a distinctive coloring, to designate which input devices 18-24 are to be manipulated by each player. For example, the lights 70, 74 corresponding to the push button 18 and pull knob 22, respectively, may be red, and the lights 72, 76 correspond to the push button 20 and twist knob 24, respectively, may be yellow. At the beginning of the game, one player may grasp the arm 14 and may be responsible for manipulating the push button 18 and pull knob 22 when instructed, and the other player may grasp the arm 16 and may be responsible for manipulating the push button 20 and twist knob 24 when instructed.

Once the two-player game is initiated, the game 10 may output audible or visual messages instructing the players to manipulate the input devices 18-24, along with an audible underlying beat. When instructed to manipulate the pull knob 22, the player grasping the arm 14 must pull the pull knob 22 within the allowed time period in order to continue the round. Similarly, the player grasping the arm 16 must rotate the twist knob 24 within the time period when instructed to do so. If a player fails to manipulate their input device 22, 24 within the time limit, the other player may be declared the winner of the two-player game. If the player successfully manipulates their knob 22, 24, the game continues with the game 10 broadcasting subsequent instructions. When the players are instructed to manipulate the push buttons 18, 20, such as when the game 10 verbally instructs the players to "Bop It," the players race to be the first one to manipulate their push button 18, 20. Consequently, the player grasping the arm 14 attempts to press the red push button 18 first, and the player grasping the arm 16 attempts to press the yellow push button 20 first. The first player to press their push button 18, 20 as determined by the processor 50 may be awarded a point, and the game 10 may output a race-winner signal announcing which color player won the race. The processor 50 may be programmed to store the number of points awarded to each player via point counters in the memory 52, and may compare the points awarded to each player to a predetermined winning number of points. The two-player game may end when either one player reaches the winning number of points, or one player does not successfully manipulate their knob 22, 24 within the time limit, and the game 10 may announce the winning player of the two-person game.

In another alternate game play format, the game 10 may provide both audio and visual commands instructing the player or players as to which input device 18-24 to manipulate. As with the other game play formats, the game 10 may output verbal or musical messages instructing a player to manipulate the input devices 18-24, along with an audible underlying beat. The game 10 may additionally illuminate one of the lights 70-76 each time an audible instruction is issued. In this game play format, the player may be required to perform the specified action only if the illuminated light 70-76 corresponds to the input device 18-24 specified by the audible instruction. For example, if the game issue a verbal instruction to "Pull It" and illuminates the light 74 of the pull knob 22, the player must pull the pull knob 22 within the time limit to successfully respond to the instruction. If, however, the verbal instruction to "Pull It" is accompanied by the illumination of the light 76 of the twist knob 24, the player is not required to perform an action and waits until the next instruction is issued by the game 10. If the player manipulates an input device 18-24 when the illuminated light 70-76 does not match the audible instruction, the game is over. In one embodiment, the player may press either of the push buttons 18, 20 in response to an audible instruction to "Bop It" and the illumination of either or both of the lights 66, 68. Alternatively, the processor 50 may illuminate only one of the lights 18, 20 along with the instruction to "Bop It," and the player may be required to press the push button 18, 20 corresponding to the illuminated light 66, 68.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A hand-held game apparatus for one or more users, comprising:

a center element;

a first outwardly-extended arm connected to the center element, wherein the first arm is stationary with respect to the center element;

a second outwardly-extending arm movably connected to the center element, wherein the second arm is movable relative to the center element between a first position and a second position;

a first input device on the first arm, the first input device being movable relative to the first arm by a first mechanical action;

a first switch on the first arm operatively connected to the first input device so that the first switch is actuated by movement of the first input device by the first mechanical action;

a second input device on the second arm, the second input device being movable relative to the second arm by a second mechanical action, wherein the second mechanical action is different than the first mechanical action;

a second switch on the second arm operatively connected to the second input device so that the second switch is actuated by the movement of the second input device by the second mechanical action, and wherein movement of the second arm does not actuate the second switch;

a first race input device on the center element, the first race input device being movable relative to the center element by a race mechanical action, wherein the race mechanical action is different than the first and second mechanical actions;

a first race switch on the center element operatively connected to the first race input device so that the first race switch is actuated by the movement of the first race input device by the race mechanical action;

a second race input device on the center element, the second race input device being movable relative to the center element by the race mechanical action;

a second race switch on the center element operatively connected to the second race input device so that the second race switch is actuated by the movement of the second race input device by the race mechanical action, wherein a first subset of input devices includes the first input device and the first race input device, and a second subset of input devices includes the second input device and the second race input device;

an output device; and a controller operatively connected to each of the switches and to the output device, the controller being programmed to cause the output device to output a first command signal specific to one of the mechanical actions of the input devices, the controller being programmed to determine whether any of the switches are actuated within a predetermined time period, the controller being programmed to cause the output device to output a second command signal specific to one of the mechanical actions of the input devices in response to determining that the switch corresponding to the input device requiring the mechanical action of the first command signal was actuated within the predetermined time period if the first command signal is not specific to the race input devices;

the controller being programmed to cause the output device to output a first race-winner signal corresponding to the first race input device and a second command signal specific to one of the mechanical actions of the input devices in response to determining that the first race switch was actuated within the predetermined time period and before the second race switch if the first command signal is specific to the race input devices; and the controller being programmed to cause the output device to output a second race-winner signal corresponding to the second race input device and a second command signal specific to one of the mechanical actions of the input devices in response to determining that the second race switch was actuated within the predetermined time period and before the first race switch if the first command signal is specific to the race input devices.

2. The game apparatus according to claim 1, wherein the second arm is pivotally connected to the center element and moves in a circular path between the first position and the second position.

3. The game apparatus according to claim 1, wherein the output device comprises a plurality of illumination sources, each illumination source corresponding to one of the input devices, and wherein the command signal is the illumination of the illumination source specific to the input devices requiring the same mechanical action.

4. The game apparatus according to claim 1, wherein the controller is programmed to increment a first point counter corresponding to the first race input device in response to determining that the first race switch was actuated within the predetermined time period and before the second race switch if the first command signal is specific to the race input devices; and the controller is programmed to increment a second point counter corresponding to the second race input device in response to determining that the second race switch was actuated within the predetermined time period and before the first race switch if the first command signal is specific to the race input devices.

5. The game apparatus according to claim 1, wherein the output device comprises an audible output device, and wherein the controller is programmed to cause the audible output device to output an audible command signal specific to the input devices requiring the same mechanical action.

6. The game apparatus according to claim 5, wherein the controller stores male voice command signals and female voice command signals as audible command signals for the audible output device, wherein one of the input devices is a voice selection input device, and wherein the controller outputs one of the male voice command signals, the female voice command signals and a combination of the male and female voice command signals to the audible output device based on the number of actuations of the voice selection input device.

7. The game apparatus according to claim 1, wherein the controller is programmed to cause the output device to output an error signal in response to detecting the actuation of an input device other than input device specified in the first command signal, and the controller is programmed to cause the output device to output an error signal in response to determining that no input device specified in the first command signal is actuated within the predetermined time period.

8. A hand-held game apparatus for one or more users, comprising:

a center element;

a first outwardly-extending arm connected to the center element, wherein the first arm is stationary with respect to the center element;

a second outwardly-extending arm moveably connected to the center element, wherein the second arm is moveable relative to the center element between a first position and a second position;

a first input device on the first arm, the first input device being movable relative to the first arm by a first mechanical action;

a first switch on the first arm operatively connected to the first input device so that the first switch is actuated by movement of the first input device by the first mechanical action;

a second input device on the second arm, the second input device being movable relative to the second arm by a second mechanical action, wherein the second mechanical action is different than the first mechanical action;

a second switch on the second arm operatively connected to the second input device so that the second switch is actuated by the movement of the second input device by the second mechanical action, and wherein movement of the second arm does not actuate the second switch;

a pair of center element input devices dispose on opposite sides of the center element, the center element input devices being movable relative to the center element by a third mechanical action, wherein the third mechanical action is different than the first and second mechanical actions;

a pair of center element switches on the center element, each operatively connected to one of the center element input devices so that each center element switch is actuated by the third mechanical action of the corresponding center element input device;

an audible output device;

a visual output device; and a controller operatively connected to each of the switches, to the audible output device, and to the visual output device, the controller being programmed to cause the audible output device to output an audible command signal specific to one of the mechanical actions, the controller being programmed to cause the visual output device to output a visual command signal specific to one of the mechanical actions, the controller being programmed to determine whether any of the switches are actuated within a predetermined time period, and the controller being programmed to cause the audible output device to output an error signal in response to detecting the actuation of any of the switches within the predetermined time period if the mechanical actions corresponding to the visual command signal is not the same as the mechanical actions corresponding to the audible command signal.

9. The game apparatus according to claim 8, wherein the second arm is pivotally connected to the center element and moves in a circular path between the first position and the second position.

10. The game apparatus according to claim 8, wherein the visual output device comprises a plurality of illumination sources, each illumination source corresponding to one of the mechanical actions, and wherein the visual command signal is the illumination of the illumination source corresponding to the selected mechanical actions.

11. The game apparatus according to claim 8, wherein the controller stores male voice command signals and female voice command signals for the audible output device, wherein the game apparatus comprises a voice selection input device, and wherein the controller outputs one of the male voice command signals, the female voice command signals and a combination of the male and female voice command signals to the audible output device based on the number of actuations of the voice selection input device.

12. The game apparatus according to claim 8, wherein the controller is programmed to cause the audible output device to output an error signal in response to detecting the actuation of a switch other than the switch actuated by the mechanical actions corresponding to the audible command signal if the mechanical action corresponding to the visual command signal is the same as the mechanical action corresponding to the audible command signal, and the controller is programmed to cause the audible output device to output an error signal in response to determining that none of the switches are actuated within the predetermined time period if the mechanical action corresponding to the visual command signal is the same as the mechanical action corresponding to the audible command signal.

13. A hand-held game apparatus for one or more users, comprising:

a center element;

a first outwardly-extending arm connected to the center element, wherein the first arm is stationary with respect to the center element;

a second outwardly-extending arm moveably connected to the center element, wherein the second arm is moveable relative to the center element between a first position and a second position;

a first input device on the first arm, the first input device being movable relative to the first arm by a first mechanical action;

a first switch on the first arm operatively connected to the first input device so that the first switch is actuated by movement of the first input device by the first mechanical action;

a second input device on the second arm, the second input device being movable relative to the second arm by a second mechanical action, wherein the second mechanical action is different than the first mechanical action;

a second switch on the second arm operatively connected to the second input device so that the second switch is actuated by the movement of the second input device by the second mechanical action, and wherein movement of the second arm does not actuate the second switch;

a first race input device on the center element, the first race input device being movable relative to the center element by a race mechanical action, wherein the race mechanical action is different than the first and second mechanical actions;

a first race switch on the center element operatively connected to the first race input device so that the first race switch is actuated by the movement of the first race input device by the race mechanical action;

a second race input device on the center element, the second race input device being movable relative to the center element by the race mechanical action;

a second race switch on the center element operatively connected to the second race input device so that the second race switch is actuated by the movement of the second race input device by the race mechanical action, wherein a first subset of input devices includes the first input device and the first race input device, and a second subset of input devices includes the second input device and the second race input device;

an audible output device; and a controller operatively coupled to each of the switches and to the audible output device, the controller being programmed to select one of the mechanical actions, the controller being programmed to cause the audible output device to output an audible command signal specific to the selected mechanical action, the controller being programmed to determine whether the switch corresponding to the selected mechanical action is actuated within a predetermined time period, the controller being programmed to cause the audible output device to output an error signal in response to detecting the actuation of a switch other than a switch corresponding to the selected mechanical action, and the controller being programmed to cause the audible output device to output an error signal in response to determining that a switch corresponding to the selected mechanical action is not actuated within the predetermined time period.

14. The game apparatus according to claim 13, wherein the second arm is pivotally connected to the center element and moves in a circular path between the first position and the second position.

15. The game apparatus according to claim 13, wherein the audible command signal is a first command signal specific to one of the mechanical actions of the input devices, the controller being programmed to determine whether any of the switches are actuated within the predetermined time period, the controller being programmed to cause the audible output device to output a second command signal specific to one of the mechanical actions of the input devices in response to determining that the switch corresponding to the input device requiring the mechanical action of the first command signal was actuated within the predetermined time period if the first command signal is not specific to the race input devices, the controller being programmed to cause the audible output device to output a first race-winner signal corresponding to the first race input device and a second command signal specific to one of the mechanical actions of the input devices in response to determining that the first race switch was actuated within the predetermined time period and before the second race switch if the first command signal is specific to the race input devices; and the controller being programmed to cause the audible output device to output a second race-winner signal corresponding to the second race input device and a second command signal specific to one of the mechanical actions of the input devices in response to determining that the second race switch was actuated within the predetermined time period and before the first race switch if the first command signal is specific to the race input devices.

16. The game apparatus according to claim 15, wherein the controller is programmed to increment a point counter corresponding to the first of the race switches actuated within the predetermined time period.

17. The game apparatus according to claim 13, comprising a plurality of illumination sources operatively connected to the controller, each illumination source corresponding to one of the mechanical actions, and wherein the controller is programmed to illuminate the illumination sources when the audible output device outputs the audible command signal, the controller is programmed to determine whether any of the switches are actuated within the predetermined time period, and wherein the controller is programmed to cause the audible output device to output an error signal in response to detecting the actuation of any of the switches within the predetermined time period if the mechanical action corresponding to the illuminated illumination source is not the same as the mechanical action corresponding to the audible command signal.

18. The game apparatus according to claim 13, wherein the controller stores male voice command signals and female voice command signals for the audible output device, wherein the game apparatus comprises a voice selection input device, and wherein the controller outputs one of the male voice command signals, the female voice command signals and a combination of the male and female voice command signals to the audible output device based on the number of actuations of the voice selection input device.

* * * * *